United States Patent [19]

Watanabe

[11] 4,231,132

[45] Nov. 4, 1980

[54] APPARATUS FOR CLEANING INNER SURFACES OF HOLLOW CYLINDRICAL CONTAINER

[76] Inventor: Makoto Watanabe, 1070-4 Oaza Shiba, Kawaguchi Saitama-ken, Japan, 332

[21] Appl. No.: 971,167

[22] Filed: Dec. 20, 1978

[30] Foreign Application Priority Data

Jul. 31, 1978 [JP] Japan ..... 53-92473

[51] Int. Cl.[3] ..... B08B 9/08

[52] U.S. Cl. ..... 15/56; 15/179

[58] Field of Search ..... 15/56, 57, 58, 70–72, 15/73, 101, 179; 134/104, 167 R, 168 R

[56] References Cited

U.S. PATENT DOCUMENTS

| | | | |
|---|---|---|---|
| 1,539,718 | 5/1925 | Crum | 15/56 |
| 2,115,439 | 4/1938 | Wolfner | 15/58 |
| 2,628,379 | 2/1953 | Darrah | 15/72 |

FOREIGN PATENT DOCUMENTS

| | | | |
|---|---|---|---|
| 1578754 | 7/1969 | France | 15/56 |
| 94712 | 10/1969 | France | 15/56 |
| 576117 | 4/1958 | Italy | 15/56 |
| 37228 | 6/1906 | Switzerland | 15/56 |
| 44828 | 2/1909 | Switzerland | 15/56 |
| 46846 | 3/1909 | Switzerland | 15/56 |

*Primary Examiner*—Edward L. Roberts
*Attorney, Agent, or Firm*—William A. Drucker

[57] ABSTRACT

An apparatus for washing, cleaning or polishing inner surfaces of a hollow cylindrical container, comprising: a rotatable vertical shaft which is adjustable in its length to obtain a desired shaft length to match the depth of the container; at least one brush-supporting arm extending substantially horizontally from said vertical shaft for washing the inner side surface of the container and consisting of a plurality of brush-carrying detachable arm-constituting coupling members so as to be adjustable for the inner diameter of the container, and an inner bottom surface washing brush-supporting arm consisting of a plurality of brush-carrying detachable coupling members, one of these latter coupling members being pivotably connected to the lower end portion of the vertical shaft so that their brushes fit with an inclined inner bottom surface.

9 Claims, 3 Drawing Figures

APPARATUS FOR CLEANING INNER SURFACES OF HOLLOW CYLINDRICAL CONTAINER

BACKGROUND OF THE INVENTION (a) Field of the Invention

The present invention relates to an apparatus for washing the inner surfaces of a hollow cylindrical container, and more particularly it pertains to an apparatus for washing, cleaning or polishing the inner side surface and the inner bottom surface of a hollow cylindrical container by rotating the brush means secured, by supporting means, to a rotatable vertical shaft while being in contact with these surfaces.

(b) Brief Description of the Prior Art

In known apparatuses designed for washing the inner surfaces of hollow cylindrical containers, there has been proposed, for example, in Japanese Utility Model Registration No. 1,199,965, an apparatus arranged so that brush means are provided sidewise and bottomwise of a rotatable arm so as to be able to wash the inner surfaces of hollow cylindrical containers having depths and inner diameters of certain limited ranges. However, in case the hollow cylindrical containers have depths and inner diameters which depart from said certain limited ranges, it is no longer possible to wash and clean these surfaces entirely. In addition, in case the inner bottom surface of the container is inclined, this bottom surface as well as a part of the inner side surface of the container are out of reach of the washing brushes, and thus desirable entire washing and cleaning of these surfaces is hampered.

SUMMARY OF THE INVENTION

It is, therefore, an object of the present invention to provide an apparatus for washing, cleaning or polishing the inner surfaces of a hollow cylindrical container, which features by the following facts: (1) the length of the rotatable vertical shaft can be adjusted as required for a considerable broad range to suitably correspond to different depths of containers; (2) the lengths of the brush-supporting arms intended for use in washing, cleaning or polishing the inner side surface of a hollow cylindrical container can be suitably adjusted to fit with the inner diameter of container by increasing or decreasing the number of the coupling members which constitute such arm; and (3) one of the detachable coupling members constituting the brush-supporting arm for use in washing, cleaning or polishing the inner bottom surface of a hollow cylindrical container is pivotably secured to the lower end portion of the rotatable vertical shaft so that an inclined inner bottom surface can be entirely washed or polished satisfactorily. Thus, the present invention contemplates the provision of an apparatus for washing, cleaning or polishing substantially the entire inner side surface as well as inner bottom surface of a hollow cylindrical container regardless of the diameter and the depth of the container, and regardless of the inclination of the bottom surface of this container.

BRIEF DESCRIPTION OF THE DRAWINGS

Like parts are given like reference numerals and symbols throughout the drawings.

DETAILED DESCRIPTION OF THE PREFERRED EMBODIMENTS

As briefed above, the present invention contemplates the elimination of the inconveniences encountered by the use of known washing apparatuses.

Figure 1:
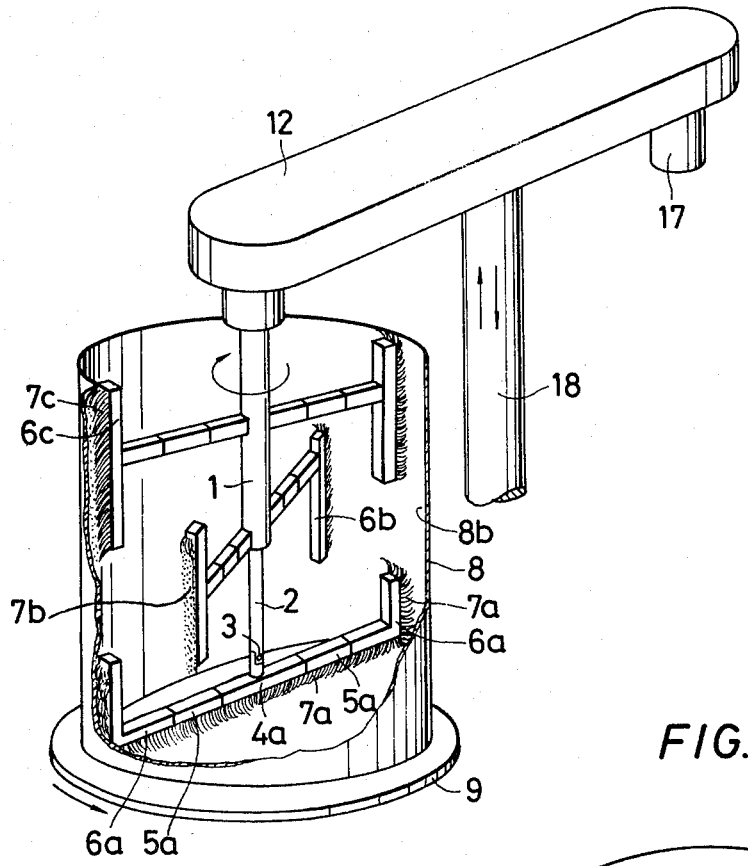
FIG. 1 is a diagrammatic perspective view, partly broken away, for explaining an example of the apparatus of the present invention in its operating state.
Figure 2:
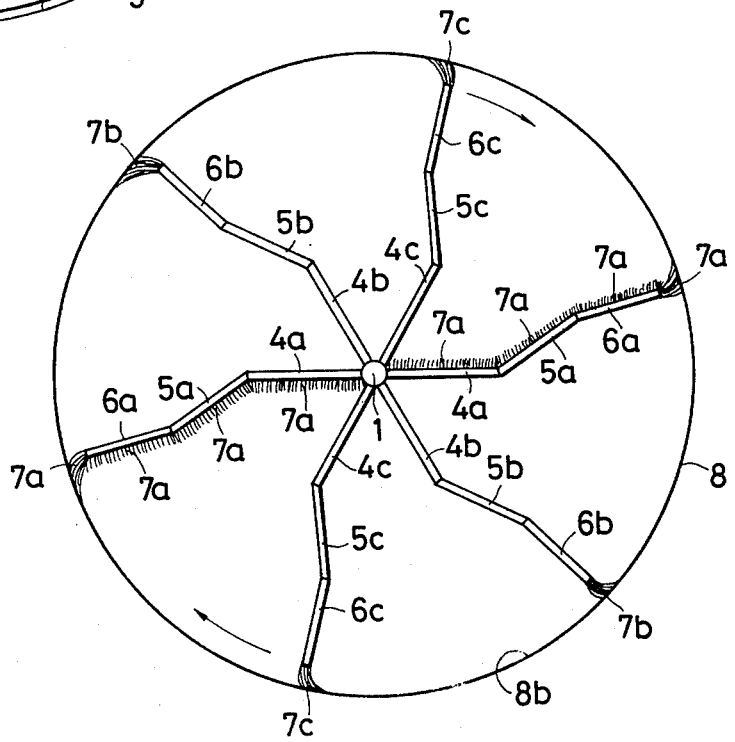
FIG. 2 is a diagrammatic explanatory plan view showing the state in which the respective brush means mounted on their mating brush-supporting arms are in contact with the inner side surface and the inner bottom surface of a hollow cylindrical container, in the apparatus of FIG. 1.
Figure 3:
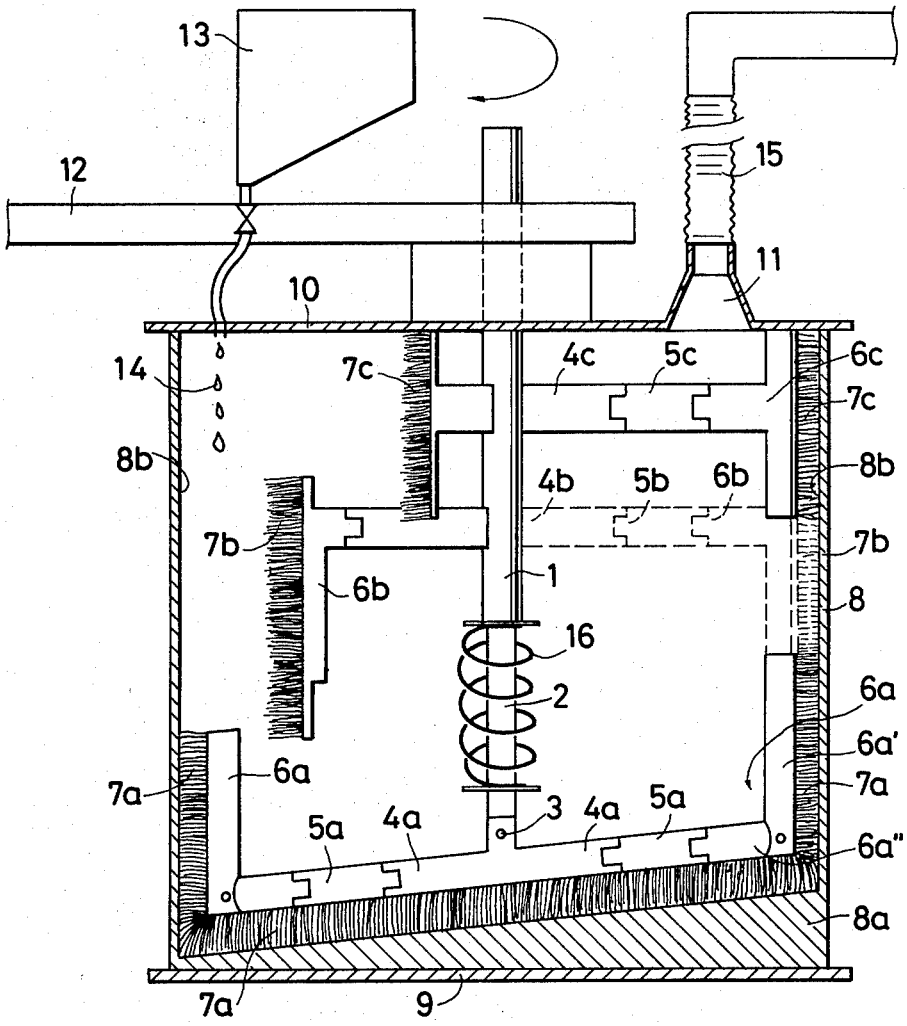
FIG. 3 is a diagrammatic sectional view of a modification of the present invention, showing the state in which a container for being washed is provided with a top cover through which a volatile detergent is introduced in drips into the container, and also with an exhaust duct to expell volatile substance from the container.

More particularly, as the technical means for attaining the first object, i.e. the adjustability of the length of the vertical rotatable shaft, there is arranged, within a hollow rotatable main shaft 1, a slidable inner shaft member 2 for rotation with said shaft 1, in such a way as to be slidable snugly within the hollow main shaft 1 and to be fixedly engageable therewith at a desired length of the slidable inner shaft member 2 by fixing means, so that the resulting overall length of the rotatable vertical shaft can be easily set to correspond to the inside depth of the container. To this purpose, spring means 16 may be provided between the main shaft 1 and the slidable inner shaft member 2, as shown in FIG. 3, and furthermore there may be provided, if required, stopping or latching means such as the structure of a leg of a tripod on both the main shaft 1 and the slidable inner shaft member 2 in any known manner, though this is not shown in the drawings for the simplicity thereof. To the rotatable vertical main shaft 1 and the inner shaft member 2, after these two have been set to obtain a shaft of a required length, there is or are securely mounted at least one, for example three brush-supporting arms represented by 4*a*, 4*b* and 4*c*, in vertically spaced stages of corresponding number when viewed from a side of the apparatus, and in zig-zag fashion at an angle relative to each other when viewed from above or bottom of the apparatus, as shown in FIG. 1 and FIG. 2. These arms 4*a*, 4*b*, 4*c* carry outermost arm members 6*a*, 6*b*, 6*c* having brush means 7*a*, 7*b*, 7*c* respectively. Thus, a collision of an upper-stage brush means with a lower-stage brush means can be avoided. It should be understood that, in case the container is of a relatively great depth, it is possible to mount another or further brush-supporting arm or arms 4*d*, . . . 4*n* on the rotatable shaft so as to be able to wash or polish the entire inner side surface of the container. Thus, according to the present invention, there is obtained a great advantage and convenience that the entire vertical length of the rotatable shaft can be varied as required to fit with the individual different depths of containers requiring a washing or polishing service.

As the technical means for attaining the second object, i.e. the adjustability of the overall lengths of the respective brush-supporting arms which extend substantially horizontally from the vertical shaft, can be attained by the provision of detachable intermediate coupling arm members such as 5*a*, 5*b* and 5*c* between the respective arm 4*a*, 4*b* and 4*c* which are directly coupled to the rotatable vertical shaft by coupling means not shown and those outermost-positioned brush-supporting arm members such as 6a, 6b and 6c which have washing brushes secured to their ends as shown in FIG. 2. It should be understood that the number of these intermediate coupling arm members may be selected as required to obtain a required overall length of the brush-supporting arms to correspond to the inner diameter of a container which needs a washing service. Needless to say, the length of the brush-supporting arms will have to be adjusted so as to correspond to individual different inner diameters of containers, and this adjustment can be easily carried out by increasing or decreasing the number of the arm-constituting intermediate coupling members. These arm members of the respective groups such as those 4a, 5a, 6a; 4b, 5b, 6b; and 4c, 5c, 6c are pivotably coupled to each other by coupling pins not shown so as to form straightly extending arms for rotation in horizontal planes, respectively, during the operation of the apparatus. Accordingly, these arm members can be easily coupled to each other and detached from each other by the attachment or removal of the coupling pins. Since these arm members are coupled together in each group by means of coupling pins, it should be understood that, as the rotatable shaft to which these arm members are secured starts rotation during the operation of the apparatus, the coupled arm members are subjected to a centrifugal force so that the coupled arm members are imparted with an effect of elongation, so that the washing brushes 7a, 7b, 7c which are secured to the ends of the brush-supporting arms are forcibly caused to be brought into contact with the inner surface 8b of the hollow cylindrical container 8. As the speed of rotation of the vertical shaft is increased, this centrifugal force will increase, and the effect of washing will become even greater. Thus, there is the great advantage that the overall length of the brush-supporting arm can be adjusted easily, depending on the length of the inner diameter of the container requiring a washing service.

As the technical means to attain the third object, i.e. the brush-supporting arm located at the lower end portion of the vertical rotatable shaft can be set to conform to an inclined inner bottom surface of a cylindrical container, the central one 4a of the arm members 4a, 5a, 6a constituting the lowermost brush-supporting arm intended for washing the bottom inner surface of the cylindrical container 8 is pivotably secured, by a pivot pin 3 such as a bolt-and-nut means or universal joint, to the lower shaft member 2 of the rotatable vertical shaft. Accordingly, the brush-supporting arm intended for the inner bottom surface of the container 8 is able to make pivotal movement about this pivot pin 3. The outermost L-shaped arm members 6a, 6a of the lowermost arm are each constituted by upwardly extending portion 6a' and a substantially horizontally extending portion 6a'' by pivot means not shown so that the portions 6a', 6a' are able to move pivotally in planes including the axis of the vertical shaft, thus permitting the brush means 7a, 7a which are carried by these portions 6a', 6a' to be brought always into contact with the inner side surface of the container 8 during the operation of the apparatus, due to the centrifugal force applied to these portions. Thus, the pieces of brush means 7a, 7a, 7a which are secured to the bottom sides of the arm members 4a, 5a, 6a are enabled to be brought into contact with the bottom inner surface of the container 8 irrespective of the inclination of this inner bottom surface. Thus, there is provided the great advantage and convenience that, during the rotation of the rotatable vertical shaft, the washing brushes 7a, 7a, 7a are always kept in contact with the inner bottom surface of the container.

It is known that a container which is used to store, for example, a paint or a printing ink is arranged to have an inclined inner bottom surface so as to obtain easy flowability of the contents stored in the bottom portion of the container. According to the apparatus of the present invention, such inclined inner bottom surface of a cylindrical container can be easily and completely washed irrrespective of the inclination imparted to the inner bottom surface of the container.

Furthermore, by arranging the lowermost brush-supporting arm to have an L-shape so that two of the brush means 7a are secured to the outer sides of the outermost-located arm members of this L-shaped arm which constitute the L-shaped arm as shown in FIG. 1, it is possible to wash not only the inner bottom surface but also its adjacent inner side surface of the container constantly at the same time during the washing operation of the apparatus.

Numeral 18 represents an exterior shaft means for uplifting and lowering the position of the apparatus.

In addition, by placing a hollow cylindrical container 8 on a rotatable turn-table 9, and by introducing the apparatus of the present invention into place of this container from the top thereof as shown in FIG. 3, washing is performed while rotating the rotatable vertical shaft and also rotating said turn-table in a direction opposite to that of the vertical shaft, whereby the effect of washing will become even more prominent.

There may be an instance wherein the detergent which is employed in washing a hollow cylindrical container is a volatile organic solvent. In such an instance the volatile substance could give an adverse effect on the health of the operator during the washing service. In such a case, there is provided to the top of the container a cover or lid 10 having a valved inlet of a volatile detergent which is supplied in drips 14 into the container 8 from a detergent reservoir 13 positioned above the container 8, and also having an exhaust duct 11 connected to an outlet duct which may be a bellows duct 15 for expelling the volatile substance to the outside of the container 8. Like the apparatus shown in FIG. 1, the apparatus of FIG. 3 is suspended and driven from a suspension-and-drive means 12 which contains a drive motor 17. The mechanism for driving the vertical shaft is not mentioned for the sake of simplicity, since such mechanism can employ any known mechanism.

Furthermore, in case of polishing or grinding rusted inner surfaces of a hollow cylindrical container, the ordinary brush means may be replaced by metal brush means. In such instance, however, powder of rust will be produced during the polishing or grinding service. The cover 10 like that shown in FIG. 3 will be suitable for leading the flying powder of rust through the exhaust dust 11. In this instance, the detergent inlet may not be needed. The arrangement of the apparatus in this instance is advantageous from the viewpoint of prevention of development of pollution.

What is claimed is:

1. An apparatus, for washing and polishing inner surfaces of a hollow cylindrical container, comprising:

(i) a support (ii) a shaft carried in rotatable manner by said support, said shaft having its axis of rotation vertical when in use, (iii) drive means coupled to said shaft for rotating it, (iv) at least one arm secured at one of its ends to said shaft for rotation therewith, (v) brush means carried at the other end of said arm for contacting the inner surface of the hollow cylindrical container, said arm including along its length a plurality of arm portions coupled serially end to end by pivot means, the axis of each said pivot means being parallel to the axis of said shaft, whereby the radial extent of each said arm is variable by relative pivoting of adjacent coupled arm portions and each arm portion is supported against gravity, and the radial extent of said arm may be varied by centrifugal force to urge the brush means against the inner surface of the hollow cylindrical container when the shaft and arm are rotated.

2. An apparatus, as claimed in claim 1, wherein a plurality of said arms are secured to said shaft at respective different points along the length of the shaft, and extend at respective angular positions about the axis of the shaft.

3. An apparatus, as claimed in claim 1, wherein said shaft comprises at least two portions which are telescopically movable one relative to the other to permit the apparatus to be adjusted to conform to the axial depth of the container.

4. An apparatus, as claimed in claim 1, comprising at the said other end of said at least one arm an end member carrying said brush means, said end member being disposed in the longitudinal direction of the shaft and being connected to said other end of the arm by pivot means permitting the end member to move in a plane including the axis of the shaft.

5. An apparatus for washing or polishing the inner surfaces of a hollow cylindrical container, comprising a rotatable vertical shaft driven by a drive means, at least one brush-supporting arm secured to said shaft and carrying brush means thereon for rotation with said shaft and for contact of its brush means with the inner surfaces of the container, and cover means to seal an open top of the hollow cylindrical container, said cover means being provided with an exhaust duct.

6. An apparatus, as claimed in claim 5, in which said cover means has a detergent inlet.

7. An apparatus, for washing and polishing inner surfaces of a hollow cylindrical container, comprising:

(i) a support (ii) a shaft carried in rotatable manner by said support, said shaft having its axis of rotation vertical when in use, (iii) drive means coupled to said shaft for rotating it, (iv) a first arm secured at one of its ends to said shaft for rotation therewith, (v) brush means carried at the other end of said first arm for contacting the inner surface of the hollow cylindrical container, said first arm including along its length a plurality of arm portions coupled serially end to end by pivot means whereby the radial extent of said first arm is variable by relative pivoting of adjacent coupled arm portions and the radial extent of said first arm may be varied by centrifugal force to urge said brush means against the inner surface of the hollow cylindrical container when said shaft and said first arm are rotated, (vi) a second brush supporting arm coupled by a universal joint to a lower part of said shaft and having thereon a radially positioned brush, said second arm being movable by means of said joint with respect to the axis of the shaft to permit said radial brush to follow a container bottom which is inclined with respect to the shaft axis.

8. An apparatus, for washing and polishing inner surfaces of a hollow cylindrical container, comprising:

(i) a support (ii) a shaft carried in rotatable manner by said support, said shaft having its axis of rotation vertical when in use, (iii) drive means coupled to said shaft for rotating it, (iv) at least one arm secured at one of its ends to said shaft for rotation therewith, (v) brush means carried at the other end of said arm for contacting the inner surface of the hollow cylindrical container, and (vi) cover means to seal an open top of the hollow cylindrical container, said cover means having an exhaust duct.

9. An apparatus, as claimed in claim 8, wherein said cover means has a detergent inlet.

* * * * *